United States Patent [19]

Derkach

[11] Patent Number: 4,727,796

[45] Date of Patent: Mar. 1, 1988

[54] WEATHER CAP FOR UPSTANDING EXHAUST PIPES

[76] Inventor: W. George Derkach, c/o 11535-160 Street, Edmonton, Alberta, Canada, T5M 3V9

[21] Appl. No.: 923,964

[22] Filed: Oct. 28, 1986

[51] Int. Cl.[4] ..... F23L 17/02

[52] U.S. Cl. ..... 98/59; 98/67; 98/122; 248/231.2; 285/901

[58] Field of Search ..... 98/59, 122, 67; 49/465; 220/85 CH, 85 F, 319, DIG. 33; 248/231.2; 285/317, 901

[56] References Cited

U.S. PATENT DOCUMENTS

| | | | |
|---|---|---|---|
| 1,256,045 | 2/1918 | Schrems | 98/122 |
| 2,749,832 | 6/1956 | Harmon | 98/59 |
| 2,805,616 | 9/1957 | Roth | 98/67 |
| 3,638,402 | 2/1972 | Thomas | 98/122 |
| 4,205,706 | 6/1980 | Jasensky | 98/59 |
| 4,335,648 | 6/1982 | Mitchell | 98/59 |
| 4,383,478 | 5/1983 | Jones | 98/59 |
| 4,398,453 | 8/1983 | Wilkerson | 98/122 |
| 4,482,267 | 11/1984 | Widerby | 98/67 |
| 4,487,112 | 12/1984 | Lindquist | 93/67 |
| 4,535,686 | 8/1985 | Hisey | 98/67 |

FOREIGN PATENT DOCUMENTS

| | | |
|---|---|---|
| 888514 | 12/1971 | Canada . |
| 987187 | 4/1976 | Canada . |
| 1141673 | 2/1983 | Canada . |

*Primary Examiner*—Albert J. Makay
*Assistant Examiner*—David W. Westphal
*Attorney, Agent, or Firm*—Burke-Robertson, Chadwick & Ritchie

[57] ABSTRACT

A weather cap for upstanding exhaust pipes for gasoline and diesel engines and the like having an improved mechanism for securing the cap to the pipe. The mechanism comprises an elongated post to extend from the upper edge of the exhaust pipe into the pipe, with a resilient strip spring secured to the post so that the strip string bears against the interior of the pipe thereby securing the cap in position on the pipe.

11 Claims, 2 Drawing Figures

WEATHER CAP FOR UPSTANDING EXHAUST PIPES

BACKGROUND OF THE INVENTION

The present invention relates to a weather cap for protecting the open, upstanding ends of exhaust pipes for gasoline and diesel engines and the like. Such caps normally operate so that they are open to permit escape of exhaust gases from the pipe during operation of the motor, but closed to cover the opening of the exhaust pipe when the engine is not operating. In this way, when the engine is not operating, they prevent the entry into the exhaust pipe of rain, snow, ice, dirt, dust and other types of foreign matter.

In conventional devices of the this type, a counterweighted flap device is pivotally secured to a frame member which is clamped to the exhaust pipe by means of a ring or a split-ring which frictionally grips the exterior cylindrical wall of the pipe. Not only are such devices unsightly, hey do not take well the alternate expansion and contraction of the exhaust pipe during consecutive periods of operation and non-operation of the engine. This may cause the clamp to become loosened and the cap to become dislodged. Alternatively, such weather caps may be difficult to remove for servicing or replacement, since often the bolt or other securing means which acts to open the ring or split-ring may have become inoperative through rust or the like. Caps of this general type are described and illustrated, for example, in Khosropour Canadian Pat. No. 1,141,673 issued Feb. 22, 1983, McElhose, et al Canadian Pat. No. 987,187 issued Apr. 13, 1976 and Westerman Canadian Pat. No. 888,514 issued Dec. 21, 1971.

In Harmon U.S. Pat. No. 2,749,832 issued June 12, 1956, an alternative type of clamp for such a weather cap is described and illustrated in which the cap is pivotally secured to a pair of cooperating clamping frame members. The clamping frame members are operatively associated with a threaded bolt. Upon tightening of the bolt the frame members clamp between them the inner and outer walls of a end portion of the exhaust pipe to thereby secure the cap in position over the open end of the exhaust pipe.

It is an object of the present invention to provide an alternative clamp construction for weather caps for upstanding exhaust pipes which will be easy to install and remove for servicing or replacement, and which will be simple and economical to construct.

SUMMARY OF THE INVENTION

In accordance with the present invention there is provided a weather cap for upstanding exhaust pipes for gasoline and diesel engines and the like. The cap comprises a frame to be secured to the upper end of the exhaust pipe, a flap and a counterweight means pivotally secured to the frame by a normally horizontally oriented pivot. The flap and the counterweight means are positioned on opposite sides of the pivot. The frame comprises an elongated post which extends into the open upper end of the pipe with its upper end protruding therefrom. The pivot is located in the upper end of the post. A resilient strip spring, for example of steel, is secured to the post below its upper end, the strip spring to bear against the interior of the pipe and thereby secure the cap in position with respect to the pipe. In a preferred embodiment of the present invention, the strip spring is of a length to circumscribe a major portion of the internal circumference of the pipe when in position and the ends of the strip spring, when in position in the pipe, are urged inwardly so that they bear against the interior of the pipe.

One size of weather cap, in accordance with the present invention, may fit a variety of sizes of exhaust pipes and may be readily constructed and simply installed.

BRIEF DESCRIPTION OF THE DRAWINGS

These and other objects and advantages of the invention will become apparent upon reading the following detailed description and upon referring to the drawings in which.

Figure 1:
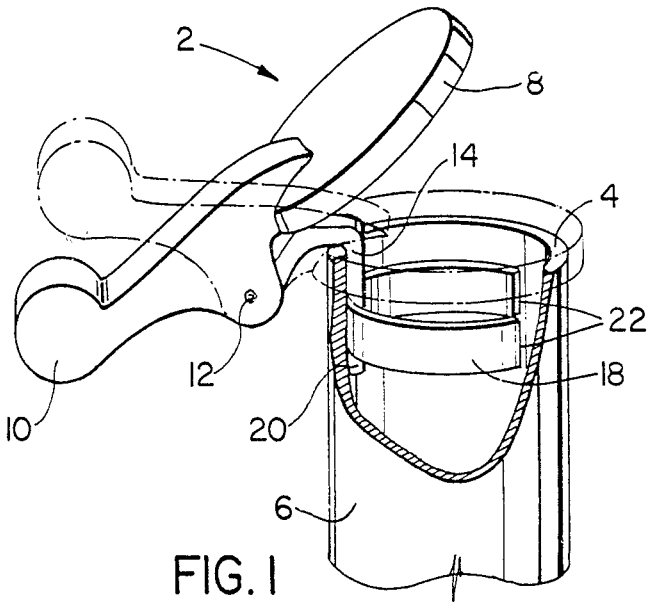
FIG. 1 is a perspective view of a weather cap in accordance with the present invention, in position secured to the upper end of an upstanding exhaust pipe.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

In the following description, similar features in the drawings have been given similar reference numerals.

Turning to the drawings, a weather cap 2 in accordance with the present invention is secured to the upper end 4 of an upstanding exhaust pipe 6 for a gasoline or diesel engine or the like as for example found on a tractor, heavy truck etcetera. The cap comprises a flap 8 which, when the engine is not operating, lies on top of upper end of exhaust pipe 6 (phantom, FIG. 1) to prevent rain, snow, ice dust, dirt or other foreign particles from entering the exhaust pipe. A counterweight 10 is provided on the opposite side from pivot 12 to flap 8, the function of counterweight 10 being to permit flap 8 to move to open position (phantom in FIG. 1) under urging from exhaust gases leaving exhaust pipe 6. Pivot 12, which as can be seen is normally horizontally oriented, passes through post 14 and secures flap 8 and counterweight 10 to it. As can be seen, pivot 12 passes through upper end 16 of post 14, which upper end overhangs the upper end 4 of exhaust pipe 6, to one side thereof.

As well, a stop 17 is formed in a upper surface portion of the overhang of upper end 16 as illustrated, to bear against a lower surface of the counterweight 10. This stop 17 is positioned to prevent flap 8 and counterweight 10 from pivoting beyond a point where the weight of the flap 8 still cause it to fall into closed position lying on top of upper end 4 when the engine ceases operation.

Figure 2:
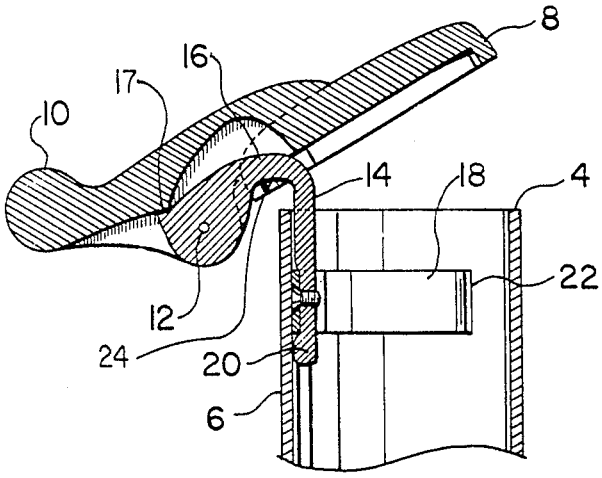
FIG. 2 is a vertical section view through the middle of the cap of FIG. 1.

The remaining portion of post 14 extends, when in position in exhaust pipe 6, down one side of exhaust pipe 6 and is held in position therein by resilient strip spring 18 which is centrally secured to lower end 20 of post 14 as illustrated. Resilient strip spring 18 is preferably made of steel or some other material, the resiliency of which is not affected by the operating conditions within the exhaust pipe 6 including the heat and exhaust gases. As can be seen in FIG. 2, strip spring 18 is of a length to circumscribe a major portion of the internal circumference of the pipe when in position. Its ends are urged inwardly, when placed in position, so that these ends of the strip spring bear against the interior of the pipe, thereby frictionally engaging the interior walls of the pipe to secure the cap 2 in position against unpurposeful disengagement.

It will be readily appreciated that the cap 2 of the construction as hereinbefore described, avoids the need of an external clamp mechanism for the exhaust pipe, thereby not only avoiding the problems of many of the prior art devices previously described, but also providing an improved aesthetic appearance for the device in position on an exhaust pipe. Moreover, one size of cap and strip spring can fit a range of sizes of exhaust pipes. As well, to clamp the device in position, all that need be done is to flex the ends 22 of resilient strip spring 18 inwardly so that strip spring 18 clears the interior walls of exhaust pipe 6 at upper end 4. The post 14 is then slid down exhaust pipe 6 to proper position determined when upper end 4 abuts stop 24 contoured in the lower surface of the overhang of upper end 16. As cap 2 is held in position mainly by frictional engagement of strip spring 18 with the interior walls of exhaust pipe 6, it can be readily removed by simply pulling cap 2 and post 14 upwardly against the bias of strip spring 18.

Thus it is apparent that there has been provided in accordance with the invention a weather cap for upstanding exhaust pipes that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. In a weather cap for upstanding exhaust pipes for gasoline and diesel engines and the like, the cap comprising a frame to be secured to the upper end of the exhaust pipe, a flap and a counterweight means pivotally secured to the frame by a normally horizontally oriented pivot, the flap and the counterweight means being positioned on opposite sides of the pivot, the improvement characterized by the frame comprising an elongated post to extend into the open upper end of the pipe, the upper end of the post protruding therefrom, the pivot being located in the upper end of the post, a resilient strip spring secured to the post below its upper end, the strip spring to bear against the interior of the pipe and thereby secure the cap in position with respect to the pipe.

2. A cap according to claim 1 wherein the strip spring is centrally secured to the lower end of the post.

3. A cap according to claim 2 wherein the strip spring is of a length to circumscribe a major portion of the internal circumference of the pipe when in position, and wherein the ends of the strip spring, when in position in the pipe, are urged inwardly to bear against the interior of the pipe.

4. A cap according to claim 3 wherein the strip spring is made of steel.

5. A cap according to claim 1 wherein the upper end of the post overhangs the open end of the pipe when in position.

6. A cap according to claim 5 wherein the post is positioned to extend into the pipe to one side thereof.

7. A cap according to claim 5 further provided with a stop means associated with the upper end of the post, the stop means being positioned so that it abuts against the upper end of the pipe to prevent the post from extending further into the pipe when the post is in position within the pipe for proper operation of the cap.

8. A cap according to claim 7 wherein the post is positioned to extend into the pipe to one side thereof and wherein the strip spring is of a length to circumscribe a major portion of the internal circumference of the pipe when in position, and wherein the ends of the strip spring, when in postion in the pipe, are urged inwardly to bear against the interior of the pipe.

9. A cap according to claim 5 wherein the upper end of the post is contoured to form a stop means, the stop means being positioned so that it abuts against the upper end of the pipe to prevent the post from extending further into the pipe when the post is in position within the pipe for operation of the cap.

10. A cap according to claim 5 wherein a surface portion of the upper end of the post is contoured to bear against a portion of the counterweight to prevent the flap and counterweight from pivoting beyond a point where the weight of the flap will still cause it to fall into closed position lying on the upper end of the pipe when the engine is inoperative.

11. In a weather cap for upstanding exhaust pipes for gasoline and diesel engines and the like, the cap comprising a frame to be secured to the upper end of the exhaust pipe, a flap and a counterweight means pivotally secured to the frame by a normally horizontally oriented pivot, the flap and the counterweight means being positioned on opposite sides of the pivot, the improvement characterized by the frame comprising an elongated post to extend into the open upper end of the pipe, the upper end of the post overhanging the open end of the pipe when in position, the upper end of the post protruding therefrom, the pivot being located in the upper end of the post, a resilient strip spring centrally secured to the lower end of the post to bear against the interior of the pipe and thereby secure the cap in position with respect to the pipe.

* * * * *